US008182310B2

(12) United States Patent
Clair et al.

(10) Patent No.: US 8,182,310 B2
(45) Date of Patent: May 22, 2012

(54) COMBINATION BRASSIERE AND TANK TOP

(75) Inventors: Andrea T. Clair, Toronto (CA); Anastasios Koskinas, Toronto (CA)

(73) Assignee: Wink Intimates, Toronto (CA)

( * ) Notice: Subject to any disclaimer, the term of this patent is extended or adjusted under 35 U.S.C. 154(b) by 424 days.

(21) Appl. No.: 12/498,136

(22) Filed: Jul. 6, 2009

(65) Prior Publication Data

US 2009/0270013 A1 Oct. 29, 2009

Related U.S. Application Data

(63) Continuation of application No. 29/300,471, filed on Mar. 31, 2008, now Pat. No. Des. 622,478.

(51) Int. Cl.
*A41C 3/00* (2006.01)

(52) U.S. Cl. ..... 450/30; 450/33

(58) Field of Classification Search ..... 450/7–11, 450/23–28, 15–18, 30–35, 92, 93, 1; 2/105, 2/106, 109–110, 113–115, 73, 78.1–78.4, 2/46, 69

See application file for complete search history.

(56) References Cited

U.S. PATENT DOCUMENTS

| | | | | | |
|---|---|---|---|---|---|
| 2,863,460 | A * | 12/1958 | Monroe | 450/11 |
| 2,869,552 | A * | 1/1959 | Smith | 450/32 |
| 3,225,768 | A * | 12/1965 | Galitzki et al. | 450/39 |
| 4,781,650 | A * | 11/1988 | Budd | 450/55 |
| 5,269,720 | A * | 12/1993 | Moretz et al. | 450/37 |
| 5,873,767 | A * | 2/1999 | Pickett | 450/1 |
| 6,935,921 | B1 * | 8/2005 | Eudenbach et al. | 450/54 |
| 7,083,494 | B2 * | 8/2006 | Sandroussi et al. | 450/31 |
| 7,306,505 | B2 * | 12/2007 | Barbour et al. | 450/30 |
| 7,409,728 | B2 * | 8/2008 | Harry | 2/106 |
| 7,549,908 | B2 * | 6/2009 | Yudkoff | 450/62 |

* cited by examiner

*Primary Examiner* — Gloria Hale
(74) *Attorney, Agent, or Firm* — McNeely, Hare & War LLP; William P. Hare

(57) ABSTRACT

The inventions relate to a garment that combines a foam cup, underwire bra combined with a tank top overlay made of a spandex blend or lace fabric for the tank top. The bra function is provided by underwires and specially formed foam cups for support and shaping of the breasts. The tank top portion of the garment is attached to one of the shoulder straps which are diagonally fixed to the tank top portion of the garment. The tank top portion of the invention is attached from each side as well as the bottom of the garment, in a unique "turn-under" sewing technique. A lace or combination spandex mix fabric attaches from the outside of the cups to the lace band at the back of the garment. This garment is used under low cut dresses and blouses, to cover cleavage and décolletage, which is an employment standard for many companies.

20 Claims, 2 Drawing Sheets

COMBINATION BRASSIERE AND TANK TOP

CROSS-REFERENCE TO RELATED APPLICATIONS

This application is a continuation of, and claims priority from, U.S. patent application Ser. No. 29/300,471, the contents of which are incorporated herein in their entirety by reference.

TECHNICAL FIELD OF THE INVENTION

This invention relates to a foam cup, underwire bra with one to three shoulder straps, the foam cups and underwires provide support and lift for small to very large breast, providing full coverage of the nipple. The overlay, tank top portion of the garment, covers the cups to provide the appearance of a bra with a tank top overtop.

BACKGROUND OF THE INVENTION

The bra, the foam cup bra, the underwire bra and the tank top each individually are well known articles in the garment industry. Each article on its own provides a specific duty. A soft bra made only with fabric, is designed to gently support the breasts. An underwire fabric bra, provides more support than a regular fabric bra. A foam cup underwire bra, provides a solution for better support, and shaping of the breast. Each type of bra, provides a totally different result and is purchased by women with different needs.

The tank top does not provide any support, lift or coverage of the breasts, and does not provide shaping of the breast. The tank top is designed to often be worn over a bra, as a garment to be worn on its own, or under another article of clothing. The combination of the tank top over foam cups, supported by underwires is unique to this invention. It is very different from a soft cup bra with a lace overlay. The foam cup, underwire bra of this invention is designed to support, shape and lift the breast, while providing full coverage of the nipple.

SUMMARY

The invention is directed to a foam cup, underwire bra with a tank top attached, which allows women to wear one undergarment rather than two garments under low cut dresses and blouses.

The invention includes foam cups which are designed to support and uplift the breast, giving shape to the breast, while providing full coverage of the nipple area. The foam cups are specifically shaped and angled to support the breast in an angle to uplift the breasts in a natural form. The shoulder straps arc sewn directly into the foam cups, which seamlessly anchors the Shoulder straps to the cups. The cups are then covered by the Lycra blend fabric that has been bubble molded to shape over the foam cups.

The invention includes underwires which are attached to the base of the foam cups to further support the breast and foam cups.

Covering the foam cups, the underwires, the cleavage and décolletage is a Lycra blend fabric, which looks like a tank top. This fabric is attached from the outside of each foam cup, attached at the bottom under the underwires in a unique "turn under" sewing technique.

DETAILED DESCRIPTION

The foam cup, underwire bra with tank top addresses a technical problem felt by women. The inventor has recognized that there is a need for such a garment that provides the lift, support, shaping and coverage, which is provided by a foam cup, underwire bra, along with the coverage of the cleavage and lower décolletage as provided by a tank top.

The foam cup, underwire bra of the invention is worn to provide lift and support and a specific shaping of the breast as well as coverage of the nipple. Most recently tank tops rather than camisoles have been used to "layer" to provide the coverage required of the cleavage and chest, but they ride up on the body, creating lumps and bumps of the fabric, and create additional heat because of the additional layer of clothing. However, both make the wearer uncomfortable and hot.

The foam, cup, under wire bra with attached tank top addresses the requirement women have for wearing additional layers of clothing, a bra plus a tank top, under low cut garments, especially in the hot spring, summer and fall months, when an extra layer of clothing only adds to heat and discomfort. Additionally menopausal women and women who heat up easily will appreciate the elimination of an additional layer of clothing under dresses and blouses. The designers of clothing are continuing to design dresses, blouses and tops with plunging necklines. Deep V-necks have become the norm in fashion, low cut garments for women are completely inappropriate attire for career women and women in situations that require coverage of the cleavage.

Presently, many items in a women's wardrobe are virtually useless, except for an evening out on the town. This invention is designed to address this problem, allowing women to maximize their wardrobes and wear these articles without an addition tank top over the bra. The additional layer of clothing, as in "tank tops" adds an additional layer, making women feel heavier and hot. The addition of a tank top under a dress, rides up, creating bumps and bulges, which only exasperates the problem.

Figure 1:
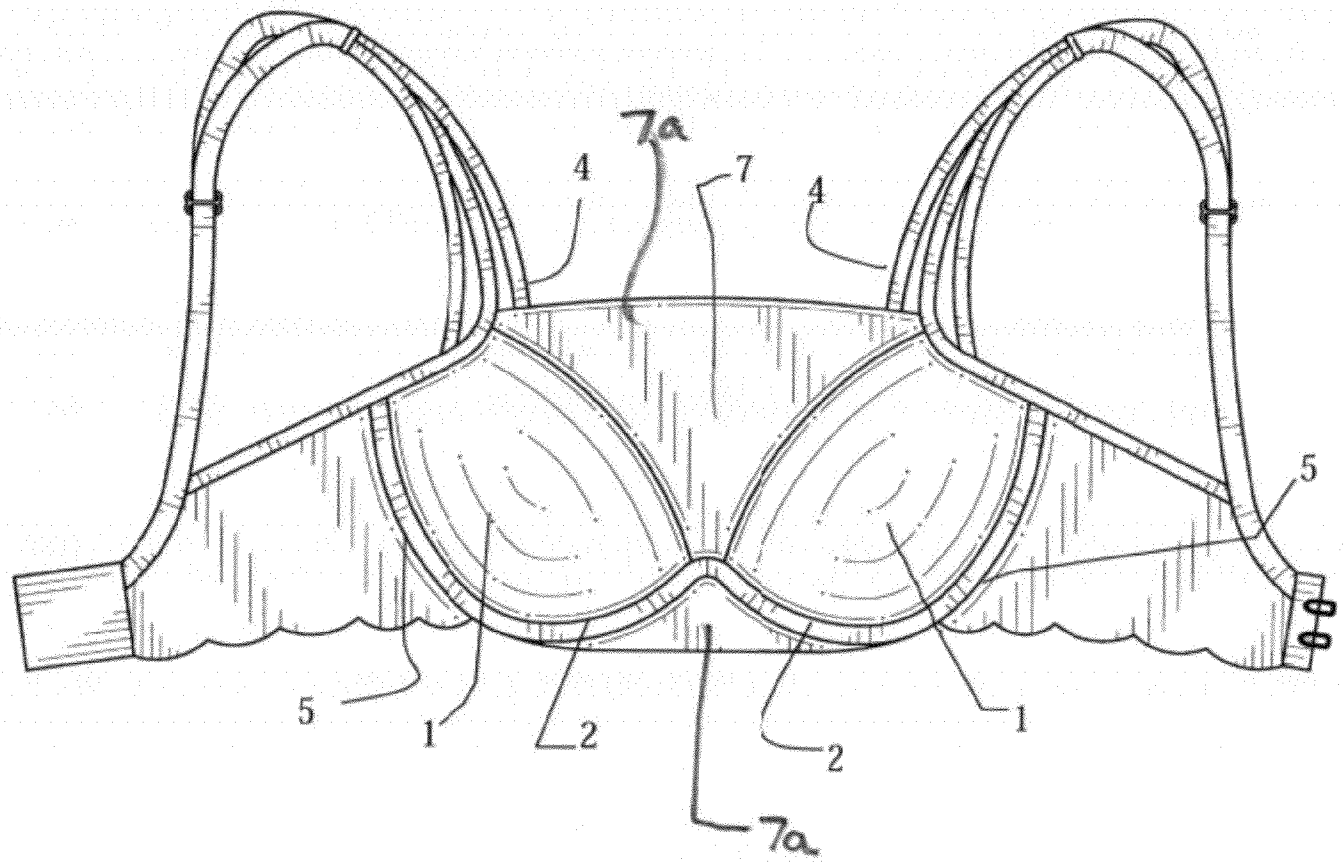
FIG. 1 is a view of the interior of the tank bra.

As shown in FIG. 1 (Interior View) the garment of the present invention includes a foam cup underwire bra with a tank top overlay over the front of the bra. The front panel, location 7 provides full coverage on the front portion from one side across to the other side of the bra portion. The tank top portion, location 7*a* extends from side to side as well as from below the underwires, location 2 with a unique "turn over" design, up to the portion where the shoulder straps start, location 4, providing coverage of part of the décolletage and all of the cleavage.

Figure 2:
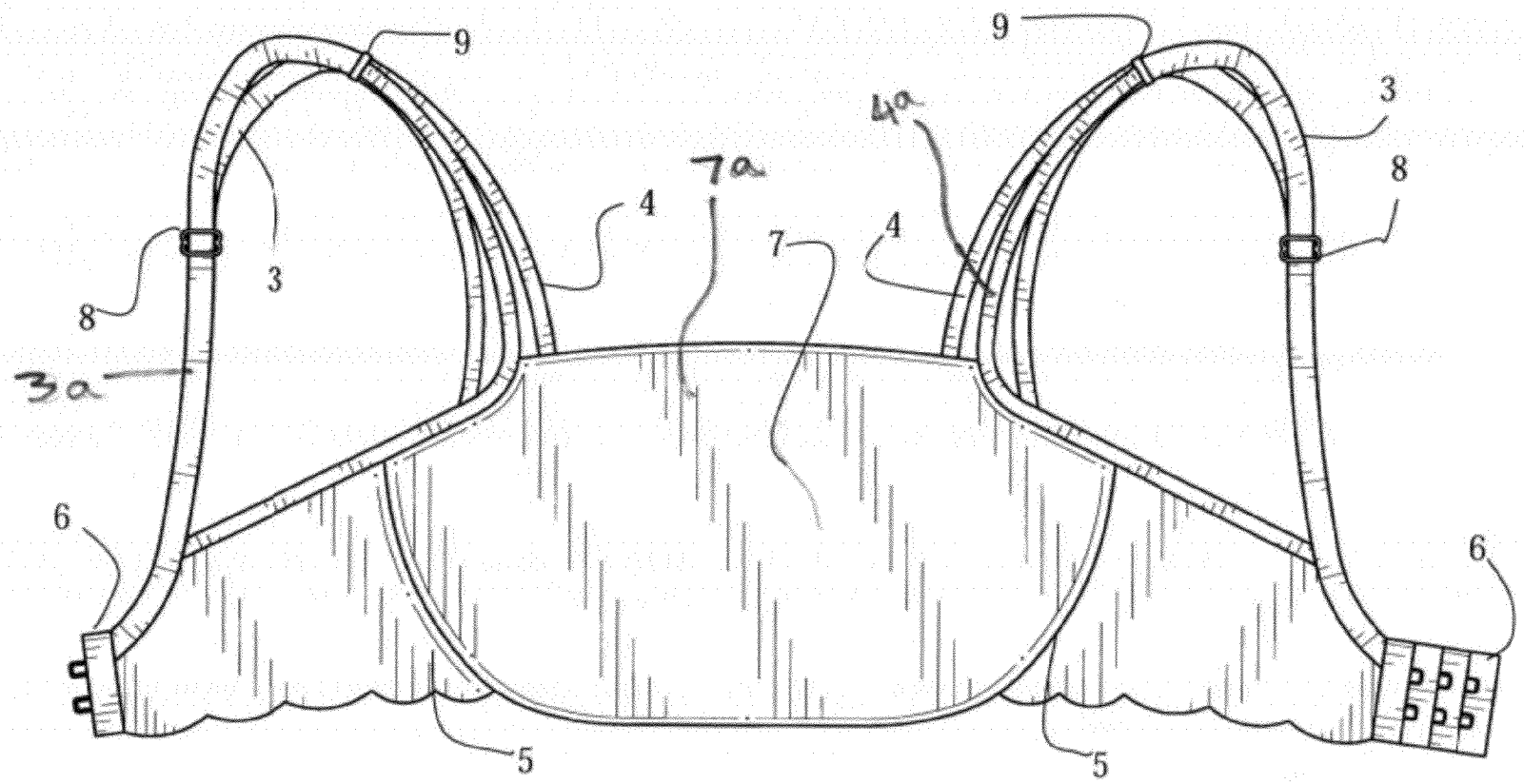
FIG. 2 is a view of the front of the tank bra.

The said garment may be made with one, two or three shoulder straps as shown in figure one, location 4. These straps are separate and positioned on an angle for full support using narrow straps. These straps are attached to the back portion of the shoulder strap, location 3 and are made of fabric with or without stretch or a combination of both. The back portion of the shoulder strap, location 3, is attached at the back to an adjustable elastic strap, location 3*a* (FIG. 2), that is attached by a slider, location 9; this adjustable elastic strap is adjustable using sliders, location 8 (FIG. 2).

The center shoulder strap, for the garment with three shoulder straps, location 4*a* in FIG. 1, or the shoulder strap, for the garment with one shoulder strap, at the front of the garment, becomes the binding material that holds together the frame of the garment. The other remaining shoulder straps, location 4, are attached internally to the foam cups, location 1 (FIG. 2).

The foam cups, location 1 may or may not provide an insert for a foam or gel insert to provide extra fullness to make the breasts appear larger. Underwires made of flexible material, location 2, are held in place by binding material, location 4*a*. The tank top portion of this garment is attached from the middle strap, location 4*a*, held together by binding material. The fabric is bubble molded over the cups, location 1 of FIG. 2 and sewn beneath the underwires, location 2. The tank top portion of the garment is made of a LYCRA® (spandex) blend fabric, location 7*a*, FIG. 2. The tank top portion of the garment is attached on both sides to lace or LYCRA® (spandex) blend band, location 5, FIG. 2, which is a 3-4 inch lace band, location 5, FIG. 2. The LYCRA® (spandex) or lace band, location 5, FIG. 2, is attached to a fastener or closure comprising of hook and eye to securely fasten the garment, location 6, FIG. 2.

EXAMPLE OF INTENDED USE

The intended use of this invention is to be worn under a wrap style dress, which has a very low cut plunging neckline. Typically the user of this style of clothing would be required to wear a full support bra, with a tank top over the bra to cover the excessive low cut of the bra which exposes all of the wearer's cleavage and décolletage. This type of dress although a great career dress with the appropriate undergarment, is not useable for work or situations that require coverage of cleavage, The foam cup underwire bra, with built in tank top, provides a solution as it provides a seamless, well formed undergarment, that does not create additional heat, bumps or bulges nor is there any material to "ride up" causing the unsightly bulges which result from wearing a full tank top under a dress.

We claim:

1. A bra comprising:

a foam cup portion having a pair of foam cups and a pair of surfaces, an inside surface configured to fit over the breasts and an outside surface on the opposite side of the foam cup portion, the pair of foam cups being positioned at an upper direction to define a décolletage region between the two cups and at a lower direction to define a lower exposed region between lower portions of the two cups;

a tank top portion positioned against the outside surface of the foam cup portion and extending above and below the foam cup portions to cover a part of the décolletage region, all of the cleavage and a part of the lower exposed region;

a pair of band portions extending away from the foam cup portion, each band portion terminating in an end having attachment means to attach to the attachment means of the other band portion; and a pair of shoulder straps having a front portion and a back portion, the front portion having a first end and a second end, the first end being attached to one of the foam cups and the second end being attached to the back portion of the shoulder strap, the back portion of the shoulder strap having a first end and a second end, the first end being attached to the second end of the front portion of the shoulder strap and the second end of the back portion being attached to the band portion.

2. The bra of claim 1, wherein the foam cups define a base region having a contour and wherein the base region is underwired to follow the contour.

3. The bra of claim 1, wherein the foam cups have an insert for foam or gel.

4. The bra of claim 2, wherein the underwire is made up of a flexible material.

5. The bra of claim 2, wherein the underwire is held in place by a binding material.

6. The bra of claim 1, wherein the foam cups are convex shaped and configured to support, uplift and give shape to the breast.

7. The bra of claim 6, wherein the foam cups are specifically shaped and angled to support the breast to uplift the breast in a natural form.

8. The bra of claim 1, wherein the foam cups provides full coverage of the nipple area of the breast of the wearer.

9. The bra of claim 1, wherein the tank top portion comprises a (spandex) blend fabric.

10. The bra of claim 9, wherein the (spandex) blend fabric has been molded to shape over the foam cups.

11. The bra of claim 10, wherein opposite sides of the (spandex) blend fabric are attached to the band portions.

12. The bra of claim 11, wherein the bands are (spandex) blend bands.

13. The bra of claim 1, wherein the attachment means comprise of a hook and an eye.

14. The bra of claim 1, wherein the shoulder straps are sewn directly into the foam cups to seamlessly anchor the shoulder straps to the foam cup.

15. The bra of claim 14, wherein the front portion of the shoulder straps includes one of one, two or three shoulder straps.

16. The bra of claim 15, wherein the back portion of the shoulder strap has an adjustable length.

17. The bra of claim 9, wherein the tank top fabric is attached to an outside surface of each foam cup and attached to a bottom surface of the foam cups in a turn-under sewing technique.

18. A method of wearing a low cut neckline dress without the need for an additional covering undergarment, the method comprising providing a bra comprising:

a foam cup portion having a pair of foam cups and a pair of surfaces, an inside surface, configured to fit over the breasts and an outside surface, on the opposite side of the foam cup portion, the pair of foam cups being positioned at an upper direction to define a décolletage region between the two cups and at a lower direction to define a lower exposed region between lower portions of the two cups;

a tank top portion positioned against the outside surface of the foam cup portion and extending above and below the foam cup portions to cover a part of the décolletage region, all of the cleavage and a part of the lower exposed region;

a pair of band portions extending away from the foam cup portion, each band portion terminating in an end having attachment means to attach to the attachment means of the other band portion; and a pair of shoulder straps having a front portion and a back portion, the front portion having a first end and a second end, the first end being attached to one of the foam cups and the second end being attached to the back portion of the shoulder straps, the back portion of the shoulder strap having a first end and a second end, the first end of the back portion being attached to the second end of the front portion of the shoulder strap and the second end of the back portion being attached to the band portion.

19. The method of claim 18, wherein the tank top portion is in lieu of wearing a tank top.

20. The method of claim 18, wherein the bra portion is in lieu of wearing a separate brassiere.

* * * * *